US005901656A

United States Patent [19]

Cheung

[11] Patent Number: 5,901,656

[45] Date of Patent: May 11, 1999

[54] WATERCRAFT WITH STACKED WING BALLAST TANKS

[76] Inventor: Maxwell C. Cheung, Irvine, Calif.

[21] Appl. No.: 08/907,279

[22] Filed: Aug. 7, 1997

Related U.S. Application Data

[XX .
[60] Provisional application No. 60/030,130, Nov. 4, 1996.

[51] Int. Cl.[6] ..... B63B 39/03
[52] U.S. Cl. ..... 114/125
[58] Field of Search ..... 114/121, 123, 114/125, 74 T, 74 R, 74 A

[56] References Cited

U.S. PATENT DOCUMENTS

| | | | |
|---|---|---|---|
| 860,492 | 7/1907 | Mehrtens . | |
| 2,928,108 | 3/1960 | Cochrane et al. | 114/125 |
| 4,162,658 | 7/1979 | Okabe et al. . | |
| 5,335,615 | 8/1994 | Bjorkman | 114/125 |
| 5,477,797 | 12/1995 | Stuart . | |

FOREIGN PATENT DOCUMENTS

| | | |
|---|---|---|
| 1311097 | 3/1963 | France . |
| 1252093 | 10/1967 | Germany . |

OTHER PUBLICATIONS

Hitachi Zosen Corp. Ad for "The Double–Hull VLCC Ohminesan".

*Primary Examiner*—Stephen Avila
*Attorney, Agent, or Firm*—Knobbe, Martens, Olson & Bear, LLP

[57] ABSTRACT

A watertight horizontal bulkhead is provided in the space between inner and outer shells of a double hull tanker. The bulkhead divides the space between the shells into vertically stacked wing ballast tanks. Overflow pipes are provided for each ballast tank, to prevent pressure from building when filling the tanks for ballast trips. In the disclosed embodiment, overflow pipes from lower ballast tanks lead upward to the deck, while a bleed line at the base of each such overflow pipe drains excess water left in the overflow pipe once the lower ballast tanks are filled.

12 Claims, 6 Drawing Sheets

WATERCRAFT WITH STACKED WING BALLAST TANKS

RELATED APPLICATION

Pursuant to 35 U.S.C. § 119(e), this application claims the priority benefit of provisional Application No. 60/030,130, filed Nov. 4, 1996.

FIELD OF THE INVENTION

The present invention relates to watercraft for cargo transport, and more particularly to double hull tankers.

BACKGROUND OF THE INVENTION

Watercraft for transporting cargo have long been built of single external hulls. The large size and load of tankers, such as those designed for the transport of crude oil or other fluid cargo, entail special structural requirements. A long history of experience with single hull tankers, however, has led to established design rules and guidelines for structural safety. Engineering principles have gradually been adapted from smaller ships to ever larger ones over a long span of time.

Experience with double hull tanker designs, on the other hand, is much more limited. Nevertheless, Congress has enforced the abrupt adoption of double hull designs by passing the Oil Pollution Act of 1990, or "OPA 90," following the environmental disaster caused by the Exxon Valdez oil spill. The outer hull of a double hull tanker serves as a sacrificial barrier, to absorb any impact in accidents, such as collisions or grounding. The outer hull thus minimizes the risk of puncturing the inner hull and consequent spills like that of the Exxon Valdez. As single hull tankers are gradually retired from service to comply with OPA 90, they are being replaced by double hull designs. Those designs lack the benefit of time testing to establish adequate margins of safety.

FIG. 4 depicts the cross-section of a conventional double hull tanker 40. The longitudinal dimension of the tanker 40 in this view would extend into and out of the paper. Typically, as is known in the art, an outer hull 42 of the tanker 40 is formed by metal plating reinforced by longitudinal stiffeners in the form of welded T-beams, L-beams or extruded bulb-beams. The plates are modularly connected to web frames which extend laterally across the width of the tanker 40. The stiffeners of the plates are fitted through slots on the web frames, and the joints are welded. An inner hull 44 may be similarly formed.

Recent inspections of older double hull tankers have revealed major structural failures at or near the double bottom area. In particular, longitudinal cracks have been found in bottom plating 54 of the inner hull 44. These fractures were centered between lateral frames and extended as long as three quarters of the distance between frames, extending along the fillet welds which fix the longitudinal stiffeners to the plating, on either side of the stiffeners. Additional fractures were found at the junction between the longitudinal stiffeners and the web frames in both the inner bottom 54 and the outer bottom 50.

Accordingly, a need exists for large watercraft which avoid such structural failures while providing the advantages of a double hull construction.

SUMMARY OF THE INVENTION

A double hull vessel is provided for the transport of cargo. The double hull vessel includes two independent hulls, one inside the other, with the two hulls spaced from one another and a common deck extending over the hulls. Both hulls include watertight, pressure-resistant side walls and bottoms. The inner hull defines a central cargo tank, while a space between the inner and outer hulls can be used to store ballast water. At least one watertight, pressure-resistant bulkhead extends between the inner and outer hull side walls, thus vertically partitioning the space between the inner and outer hulls into stacked ballast tanks. The pressure in the double bottom area is thereby reduced.

In the illustrated embodiment, the space between hulls is divided into upper and lower stacked wing tanks by a pressure-resistant bulkhead. Desirably, the stacked wing tanks each include an overpressure protector and can be filled or emptied independently.

For a ballast trip, for example, upper and lower wing tanks can be filled. Filling of a lower wing tank is stopped, in the illustrated embodiment, when overflow ballast flows from the lower tank through an overflow pipe. Any amount of ballast left in the overflow pipe after filling the lower wing tank is then allowed to bleed out of the overflow pipe.

BRIEF DESCRIPTION OF THE DRAWINGS

These and other features of the invention will now be described with reference to the drawings of certain preferred embodiments, which are intended to illustrate and not to limit the invention, and in which.

DETAILED DESCRIPTION OF THE PREFERRED EMBODIMENT

The invention is described in the context of a preferred embodiment, namely a tanker designed for the transport of crude oil. It will be understood, however, that one of ordinary skill in the art will find application for the principles herein for any of a number of different watercraft. The invention has particular utility for carrying fluid cargos, including but not limited to crude oil, processed oil or petroleum, natural gas, fresh water, grain, etc.

Figure 3:
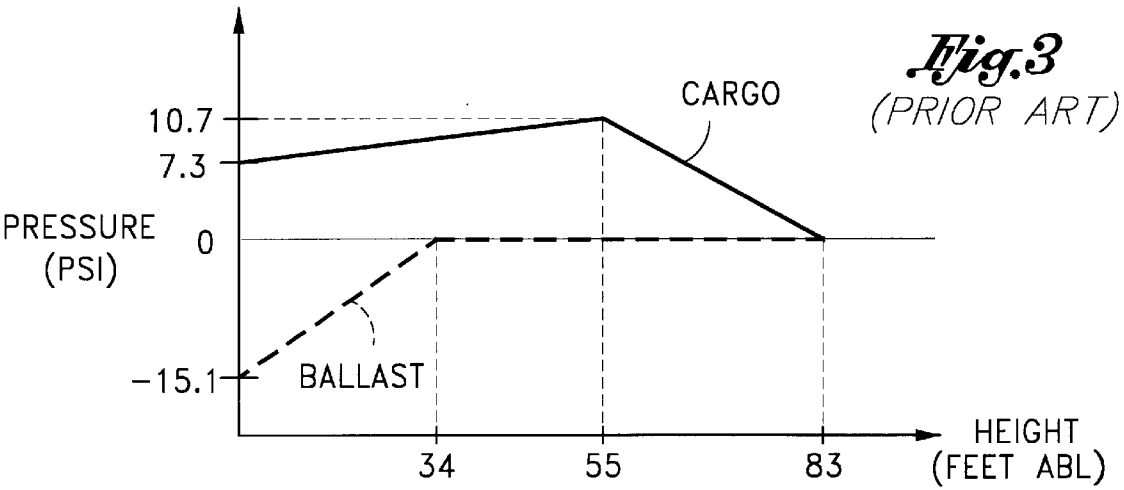
Fig. 3 (PRIOR ART)
FIG. 3 is a graph of pressure versus depth for the tanker of FIGS. 1 and 2.

With initial reference to FIG. 3, the conventional double hull tanker 20 has been found to experience significant structural failures in the double bottom area, as noted in the "Background" section above. Such failures are unexpected, since the addition of the outer hull shifts the neutral axis of the mid-ship section downward, relative to the position of such an axis in a single hull tanker. Conventional wisdom would suggest that stresses experienced by the bottom would decrease due to this shift, relative to stresses in a single hull design, while stresses in the deck would increase.

The present applicant has discussed the problems noted above in a paper entitled "Innerbottom Design Problems in Double-Hull Tankers," presented jointly with S. Slaughter to a meeting of L.A. SNAME on Sep. 12, 1996. In that paper, the applicant proposes that the structural failures in double hull tankers result from local hydrostatic pressure exerted in the double bottom area. Such pressures differ from those experienced by a single hull design, as will be clear from the following description of pressure distributions in model tankers of similar dimensions and loads.

Figure 2:
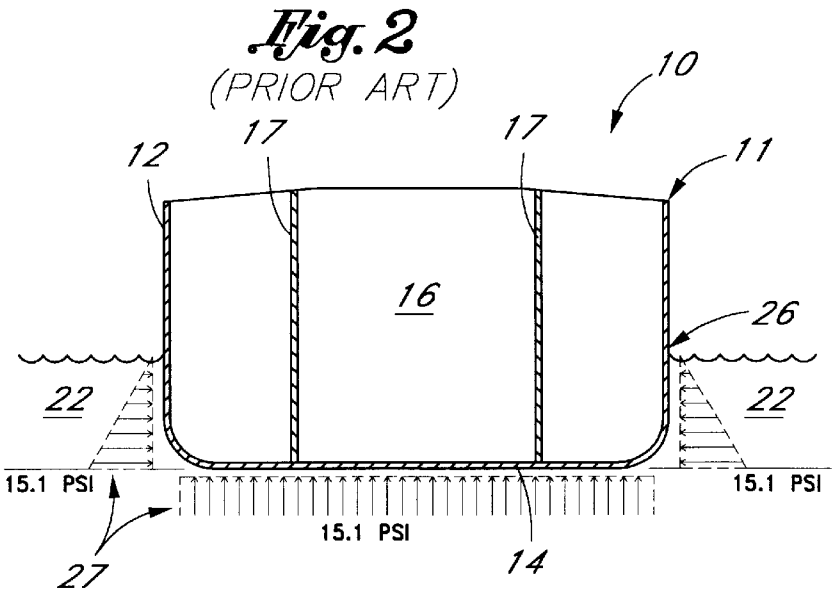
Fig. 2 (PRIOR ART)
FIG. 2 is a schematic cross-section of the tanker of FIG. 1 in a ballast condition.
Figure 1:
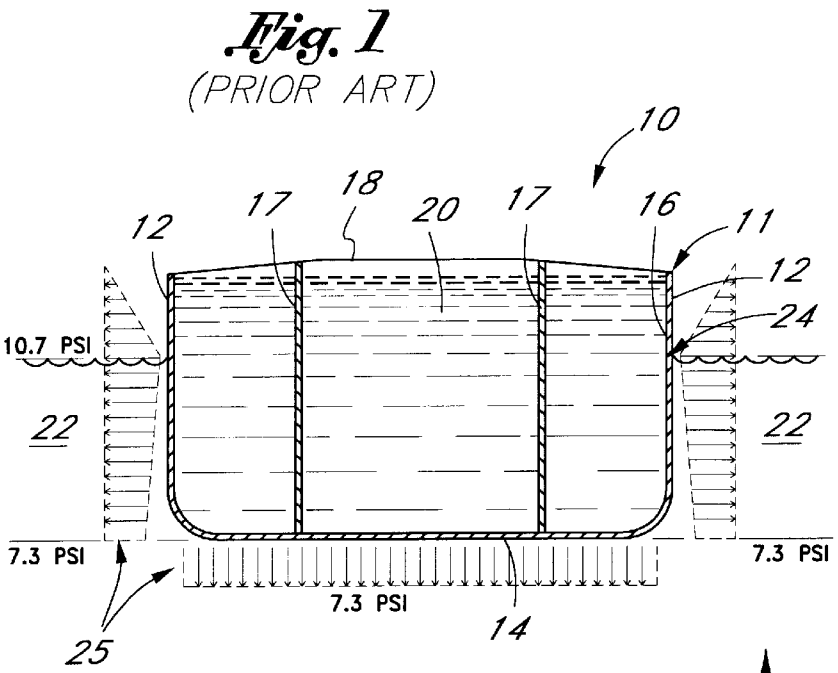
Fig. 1 (PRIOR ART)
FIG. 1 is a schematic cross-section across cargo bays of a conventional single hull tanker in a fully loaded condition, including a graphical representation of the distribution of pressure upon the hull at various depths.
Figure 8:
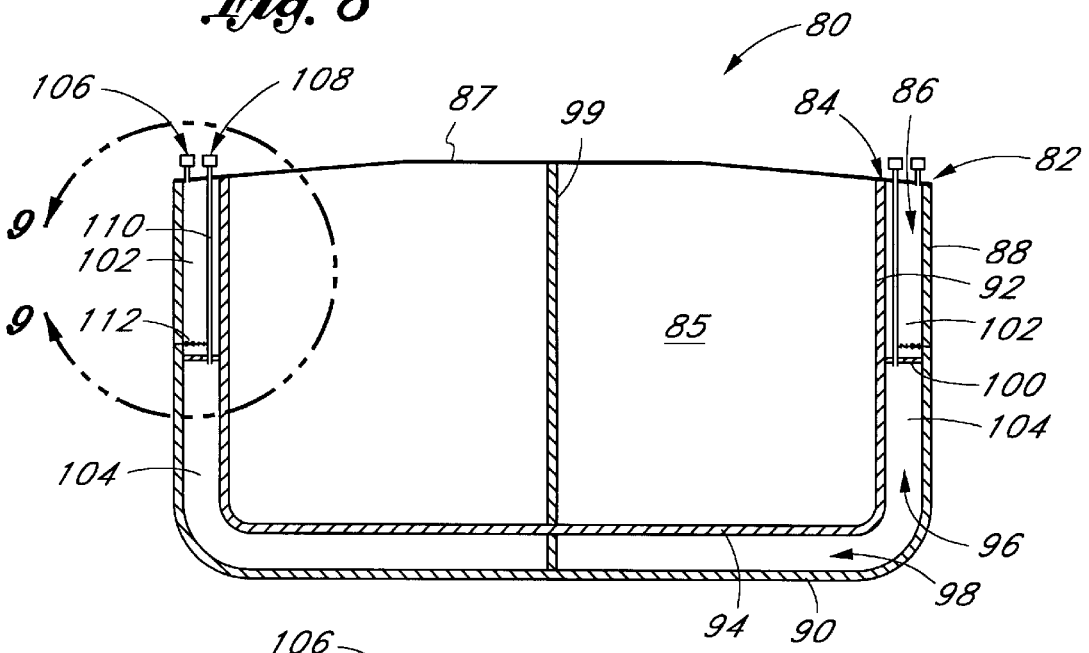
FIG. 8 is a schematic cross-section across cargo bays of a stacked wing tanker, constructed in accordance with a preferred embodiment of the present invention.
Figure 9:
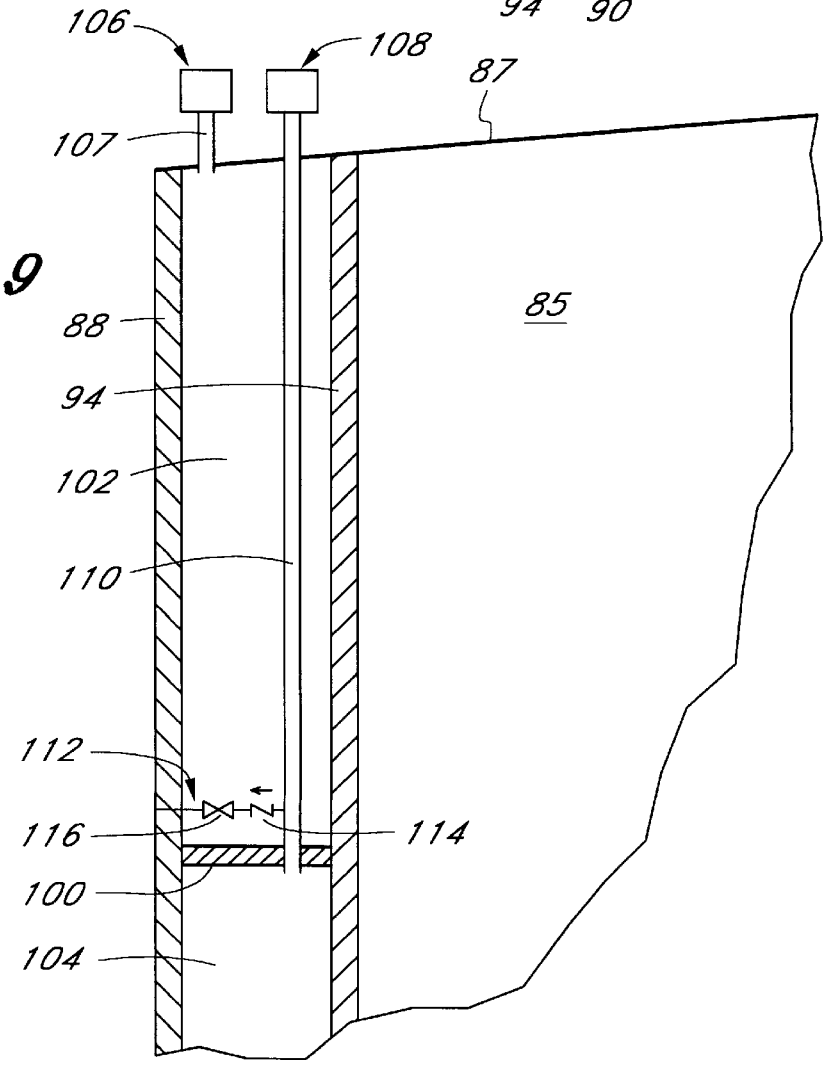
FIG. 9 is an enlarged section taken from line 9—9 of FIG. 8.

FIGS. 1 to 3 illustrate the pressure distribution of a single hull tanker 10 carrying a full cargo and in the ballast mode. FIGS. 4 to 7 similarly illustrate the pressure distributions of a conventional double hull tanker 40, showing the pressures upon both the outer shell 42 and the inner shell 44 for each of the cargo and ballast modes. FIGS. 8 and 9 show a stacked wing tanker 80, constructed in accordance with a preferred embodiment of the present invention, including an outer hull or shell 82, an inner hull or shell 84, and a horizontal wing bulkhead 100.

In the drawings and discussion below, points along the vertical side of the tankers are identified by the height measured Above Base Line ("ABL") of the watercraft. To facilitate comparison among the various tanker designs, the dimensions of the exemplary tankers are arranged to be the same, as far as possible. Additionally, the cargo and ballast draft levels are arranged to be equal for similar conditions with each of the three tankers 10, 40, 80. In particular, the following dimensions apply to the examples discussed herein:

TABLE I

| | SINGLE HULL | DOUBLE HULL | STACKED WING |
|---|---|---|---|
| Width | 152' | 152' | 152' |
| Depth | 83' | 83' | 83' |
| Wing Bulkhead (ABL) | — | — | 46.5' |
| Inner Bottom (ABL) | — | 10' | 10' |
| Cargo Draft (ABL) | 55' | 55' | 55' |
| Ballast Draft (ABL) | 34' | 34' | 34' |

It will be understood that the dimensions noted in Table I, and the hydrostatic pressures described and illustrated herein, are merely examples chosen to facilitate comparison among conventional designs and the preferred embodiment of the present invention.

The pressure distributions are calculated for fluid cargo loads with a specific gravity of 0.86 (the specific gravity of crude oil). The body of water in which the tankers float is assumed to have a density of 64 lbs/ft$^3$ (the average density of sea water). These assumptions are merely convenient constants for purposes of comparison among prior art designs and the preferred embodiment. It will be understood by one of skill in the art that the invention described herein will have utility for transport of other materials having other specific gravities, and that the advantages of the stacked wing tanker 80 apply equally to operation in fresh water.

FIG. 1 shows the prior art single hull tanker 10 in a fully loaded condition. A single hull 11, comprising substantially vertical side walls 12 and a bottom plate 14, defines a storage tank 16 within. Typically, the tank 16 includes vertical partitions 17 and/or horizontal partitions to form multiple storage compartments within the tank 16. A deck 18 extends between the side walls 12 and covers the tank 16. While FIG. 1 is schematic, it will be understood that the deck includes other structures, such as piping and manifolds, etc. The tank 16 is longitudinally sandwiched between bow and stern portions (not illustrated in the lateral sections of the drawings), which can include ballast tanks, the engine room, living quarters, and other dry compartments.

The tank 16 is shown filled with a full cargo 20 in FIG. 1, particularly comprising crude oil. Under the load of the cargo 20, the tanker 10 floats within a body of water 22 at a draft level 24, which is 55 feet above the bottom plate 14, or 55' ABL.

FIG. 1 also shows a hydrostatic pressure distribution 25, representing the net pressure exerted upon the hull 11 along the length of the side walls 12 and at the hull bottom 14. The pressure distribution shown is the sum of internal pressures from the fluid cargo 20 and external pressures from the surrounding body of water, and the pressure at a given point is roughly proportional to the length of the arrow. A net outward pressure 25 in FIG. 1 is indicated by outwardly pointing arrowheads. As is well known in the art, fluid pressure is a linear function of depth of the fluid, and depends upon the density of the fluid.

At upper portions of the hull 11, where the side walls 12 meet the deck 18, only internal pressure from the fluid cargo 20 affects the hull 11. Accordingly, the outward (positive) hydrostatic pressure increases linearly from 0 psi at the deck 18 to 10.7 psi at the draft level 24.

Below the draft level 24, the sea water 22 outside the tanker 10 exerts inward pressure upon the hull 11, tending to counteract the outward pressure from the cargo 20. Because sea water is slightly more dense than crude oil, the inward pressure from the sea water 22 increases at a greater rate than the outward pressure from the crude cargo 20. Accordingly, the outward (positive) hydrostatic pressure decreases linearly from 10.7 psi at the draft level 24 to 7.3 psi at the bottom 14.

FIG. 2 illustrates the single hull tanker 11 without cargo in the tank 16, otherwise known as the ballast mode. With buoyancy provided by a large empty tank 16, the tanker 10 would tend to rise too high on the water 22 and exhibit instability. Accordingly, some internal tanks are loaded with ballast (not shown), typically sea water which is pumped from the ocean and delivered to ballast tanks by a network of piping. The ballast causes the tanker 10 to sink somewhat and promoting stability. However, the weight of the ballast does not equal the weight of a full cargo 20 (FIG. 1), such that the tanker 10 rides much higher in the water in the ballast mode. For the illustrated single hull tanker 10, a ballast draft level 26 is only 34' ABL.

FIG. 2 also shows a hydrostatic pressure distribution 27 upon the hull 11 along the length of the side walls 12 and at the hull bottom 14. Since most compartments within the tank 16 are empty, there is essentially zero internal fluid pressure. Hydrostatic pressure from the surrounding body of water 22 thus begins at zero at the draft level 26 and increases linearly to 15.1 psi at the bottom 14. A net inward pressure is illustrated in FIG. 2 with inwardly pointing arrowheads.

FIG. 3 summarizes the pressure upon the single hull 11 as a function of the height along the hull side walls 12 in each of the cargo and ballast conditions. A net outward pressure is represented by a positive pressure, while a net inward pressure is represented as a negative pressure. As apparent from FIG. 3, the illustrated single hull tanker 10 has a net outward pressure at all points along the hull 11 in the cargo mode. It will be understood, however, that the net pressure may be inward, particularly near the bottom, in other arrangements, such as with deeper draft or less dense cargo loads.

With reference now to FIGS. 4 to 7, a conventional double hull tanker 40 is illustrated, in accordance with the prior art. The double hull tanker 40 comprises an outer shell or hull 42 and an inner shell or hull 44, defining an inter-hull space 46 therebetween. The inner hull 44 defines a tank 45 for carrying cargo. The tank 45 can also be subdivided by partitions into multiple compartments, although not illustrated as such. A deck 47 extends across and covers both the tank 45 and the inter-hull space 46.

The tank 45 is longitudinally sandwiched between bow and stern portions (not shown in the lateral sections of the drawings), which can include ballast tanks, the engine room, living quarters, and other dry compartments. The inter-hull space 46 typically wraps around the cargo tank 45 only, terminating at longitudinal ends where the bow and stern portions begin. The double hull structure thus extends in a U-shape around the middle cargo portion of the tanker 40.

The outer hull 42 comprises outer side walls 48 and an outer bottom 50. The inner hull 44 similarly comprises inner side walls 52 and a inner bottom 54. As briefly described in the "Background" section above, each of the walls and bottoms of the outer hull 42 are formed by metal plating reinforced by longitudinal stiffeners (not shown). The stiffeners of each of the outer hull 42 and inner hull 44 generally extend into the inter-hull space 46. The plating is connected by longitudinally spaced, lateral web frames with slots adapted to receive the stiffeners of the plates. The joints between adjacent plates, and between plates and frames, are welded together. The outer hull 42 thus forms a watertight, pressure-resistant skin against inward flow of sea water. The inner hull 44 similarly forms a watertight, pressure-resistant barrier to a fluid cargo.

The inter-hull space 46 comprises a pair of vertical wing tanks 56 between the outer side walls 48 and the inner side walls 52, and a double bottom space 58 between the outer bottom 50 and the inner bottom 54. The wing tanks 56 can communicate with the double bottom space 58, as illustrated. As is conventional for structural reinforcement and stability, the inter-hull space 46 is also divided into starboard and port sides by a vertical partition 59, extending longitudinally from bow to stern and vertically from the deck 47 to the center of the outer bottom 50.

Typically, the wing tanks 56 include a plurality of perforated flats (not shown) which include a large central opening. The flats hold the inner and outer hulls together and provide structural strength for spacing the outer side walls 48 from the inner side walls 52 against internal and external pressures from the fluid cargo and sea water, respectively. The flats also provide a safe platform for workers inspecting or repairing the inter-hull area, breaking up the 80' height of the inter-hull space 46 into shorter stages. The flats thereby not only space the outer hull 42 from the inner hull 44, but also reduce the risk of serious injury if a worker falls from the slippery vertical walls 48, 52.

Figure 4:
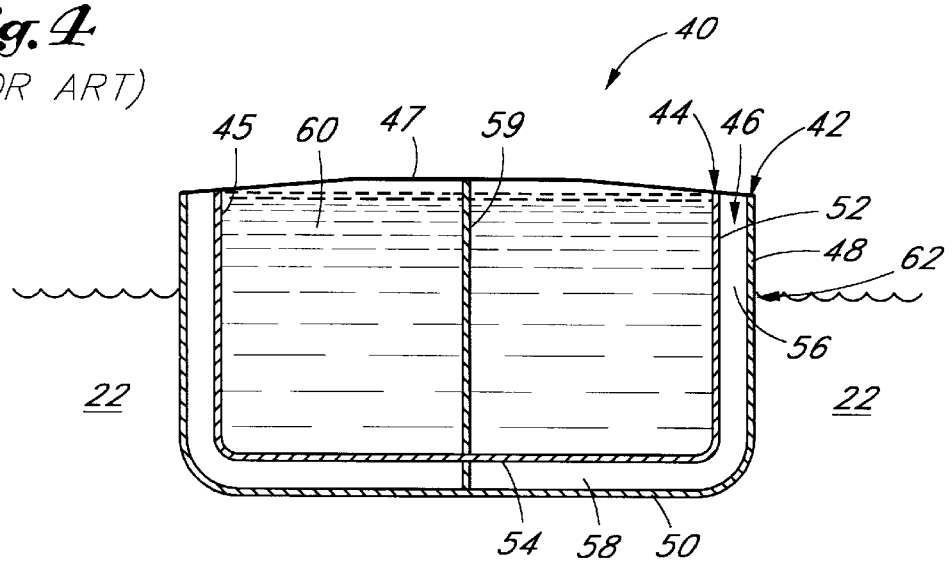
Fig. 4 (PRIOR ART)
FIG. 4 is a schematic cross-section across cargo bays of a conventional double hull tanker in a laden condition.

FIG. 4 shows the conventional double hull tanker 40 fully laden with a cargo 60 comprising crude oil. In this cargo mode, the inter-hull space 46 is empty and the portion submerged in a laden trip contributes to the buoyancy of the tanker 40. As with the single hull tanker, a cargo draft level 62 for the illustrated double hull tanker 40 is 55' ABL.

Figure 5:
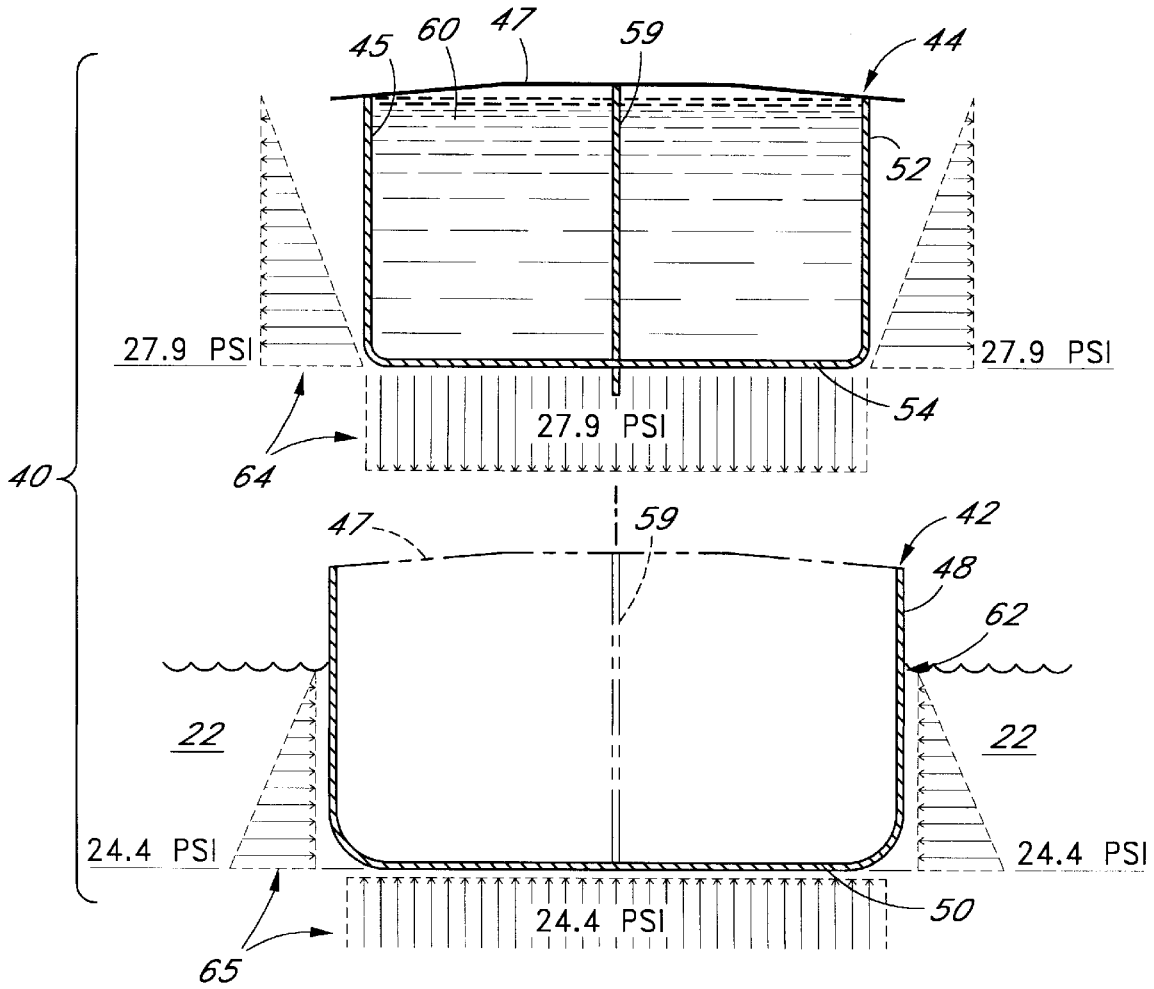
FIG. 5 is an exploded schematic cross-sectional view of the laden tanker of FIG. 4, including a graphical representation of the distribution of pressure upon inner and outer hulls.

FIG. 5 is an exploded view of the laden double hull tanker 40 of FIG. 4, with the inner hull 44 and outer hull 42 shown separately to facilitate illustration of the distribution of hydrostatic pressure along each. A pressure distribution 64 along the inner hull 44 of the conventional double hull tanker 40 is affected only by the internal pressure of the fluid cargo 60. Accordingly, the pressure increases linearly from 0 psi at the deck 47, up to 27.9 psi at the inner bottom 54. Because the inter-hull space 46 is empty, no external pressure counteracts this internal pressure.

FIG. 5 additionally shows a pressure distribution 65 along the outer hull 42 of the loaded double hull tanker 40. This distribution 65 is affected only by the external pressure of the surrounding sea water. Accordingly, the hydrostatic pressure experienced by the outer hull 42 is zero between the deck and the cargo draft level 62, while increasing linearly from the draft level 62 to 24.4 psi at the outer bottom 50. This external (inward) pressure is not counteracted by the internal pressure of the cargo load 60, due to the buffer formed by the inter-hull space 46.

Figure 6:
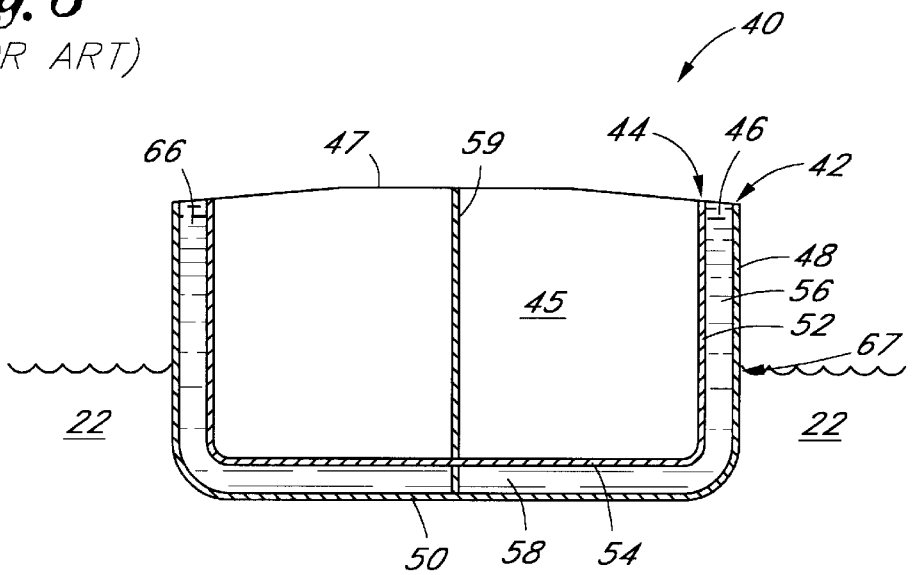
Fig. 6 (PRIOR ART)
FIG. 6 is a schematic cross-section of the conventional double hull tanker of FIG. 4, shown in a ballast condition.
Figure 7:
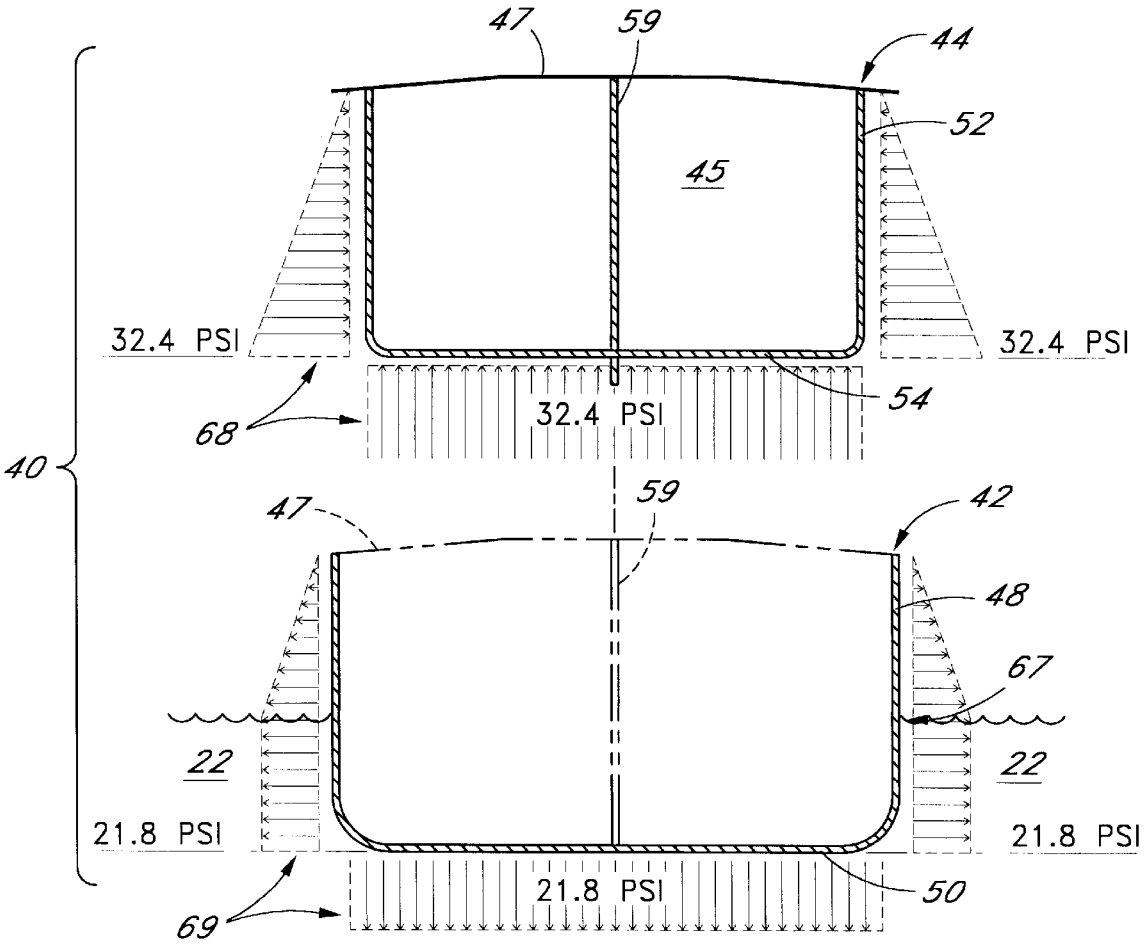
FIG. 7 is an exploded schematic cross-section of the ballasted tanker of FIG. 6, including a graphical representation of the distribution of pressure upon inner and outer hulls.

With reference now to FIGS. 6 and 7, the conventional double hull tanker 40 is shown in a ballast mode. The large empty tank 45 provides a great deal of buoyancy to the tanker 40. Accordingly, ballast is provided by filling the inter-hull space 46 with sea water 66 pumped from the ocean and delivered to each of the starboard and port sides of the inter-hull space 46 through a network of pipes. The tank 45 in which cargo is to be stored need not be subjected to the corrosive effects of sea water. The ship 40 is partially submerged to a stable ballast draft level 67 under the weight of the ballast 66, machinery, equipment and structural steel.

The central openings in the flats (not shown), which extend between the outer side walls 48 and the inner side walls 52, provide fluid communication throughout the inter-hull space 46. Such communication allows ballast water to fill the space 46 from a single filling point for each of the starboard and port sides, and similarly allows emptying each side of the space 46 of ballast water 66 with a single pump mechanism, generally situated in the double bottom space 58. Additionally, the openings provide ventilation and access for personnel and equipment to inspect the entire inter-hull space between trips to ensure structural integrity.

FIG. 7 is an exploded view of the double hull tanker 40 of FIG. 6, with the inner hull 44 and outer hull 42 shown separately to facilitate illustration of the ballast mode pressure distribution along each. The ballast sea water 66 between the hulls 42, 44 exerts an inward pressure 68 upon the inner hull 44, building linearly from 0 psi at the deck 47 to 32.4 psi at the inner bottom 54. Because the tank 45 is empty, no outward pressure counteracts this inward pressure upon the inner hull 44.

FIG. 7 additionally shows a profile of pressure 69 upon the outer hull 42 in the ballast mode. The inter-hull ballast 66 (FIG. 6) exerts the same pressure on the outer hull 42 as it does upon the inner hull 44. The outward pressure upon the outer hull side wall 48 thus increases linearly from zero at the deck to 21.8 psi at the draft level 67. Below the draft level 67, the incremental increases in internal (outward) pressure from the ballast 66 is exactly balanced by the incremental increases in external pressure from the surrounding body of water 22. Accordingly, the pressure exerted upon the outer hull 42 remains at 21.8 psi from the ballast draft level 67 to the outer bottom 50.

As will be understood from a comparison of FIGS. 1–3 with FIGS. 4–7, the conventional double hull tanker 40 is subjected to significantly higher pressures than the single hull tanker 10 for similar loads and draft levels. Each of the outer and inner hulls 42, 44 must withstand higher pressures than the single hull 11, and the discrepancy is particularly stark in a comparison of the ballast mode for each of the prior art designs.

With reference now to FIGS. 8 to 11, and initially to FIG. 8, a double hull stacked wing tanker 80 is shown, constructed in accordance with a preferred embodiment of the present invention. The stacked wing tanker 80 comprises an outer hull or shell 82 and an inner hull or shell 84, defining an inter-hull space 86 therebetween. The inner hull 84 defines a tank 85 for carrying cargo. As with conventional tankers, the cargo tank can also be subdivided by partitions into multiple compartments, although only starboard and port compartments are illustrated. A deck 87 extends across, covers and desirably seals both the cargo tank 85 and the space 86 between the hulls 82, 84.

The tank 85 is sandwiched between bow and stern portions (not shown), which can include ballast tanks, the engine room, living quarters, and other dry compartments. As in conventional double hull tankers, the inter-hull space 86 preferably wraps around the cargo tank 85 only, terminating at longitudinal ends where the bow and stern portions begin. The double hull structure thus preferably extends in a U-shape around the middle cargo portion of the tanker 80, though it will be understood that the preferred embodiment may be adapted to double hull structures which extend completely around the circumference of the tanker.

The outer hull 82 comprises outer side walls 88 and an outer bottom 90. The inner hull 84 similarly comprises inner side walls 92 and an inner bottom 94. Each of the outer hull 82 and inner hull 84 can be constructed as described above with respect to the conventional double hull tanker, with plates reinforced by longitudinal stiffeners and joined to one another by way of lateral web frames. The outer and inner hulls 82, 84 thus form watertight, pressure-resistant skins against inward flow of sea water and outward flow of fluid cargo (e.g., crude oil), respectively, during laden trips.

The inter-hull space 86 is divided into at least a pair of vertical wing tanks 96 between the outer side walls 88 and the inner side walls 92, and a double bottom space 98 between the outer bottom 90 and the inner bottom 94. The wing tanks 96 can communicate with the double bottom space 98, as illustrated, or the wing tanks 96 may be partitioned from the double bottom space 98. The inter-hull space 86 is also divided into starboard and port sides by a vertical partition 99, in accordance with conventional practice, extending longitudinally from bow to stern and vertically from the deck 87 to the center of the outer bottom 90.

The preferred wing tanks 96 also include a plurality of perforated flats (not shown) which include a large central opening for fluid communication. These flats can be constructed as described with respect to the convention double hull structure for the same structural purposes.

The tanker 80 of the preferred embodiment further comprises at least one watertight bulkhead 100 extending between the outer hull 82 and the inner hull 84. More particularly, each wing tank 96 includes at least one bulkhead 100 extending between the outer side walls 88 and the inner side walls 92. While referred to as "horizontal," it will be understood that the bulkhead 100 may be slightly tilted at an angle to the horizontal, and need not be 90° to the "vertical" side walls, which may similarly diverge from perfectly vertical.

Each bulkhead 100 is constructed like the plates of the outer inner hull 84, reinforced by longitudinal stiffeners and welded to form a watertight seal with the inner walls 92 and the outer walls 88. The bulkhead 100 and its joints with the outer and inner hulls 82, 84 are pressure resistant, such as to withstand the load of any ballast stored above it.

In the illustrated embodiment, each of the starboard and port vertical wing tanks 96 includes one bulkhead 100, dividing the wing tank 96 into an upper wing tank 102 stacked upon a lower wing tank 104. The bulkhead 100 preferably is positioned between the inner bottom 94 and the deck 87. More preferably, the bulkhead is located at a height between about 35% and 65% of the distance between the inner bottom 94 and the deck 87. Most preferably, the bulkhead is located at about half the distance between the inner bottom 94 and the deck 87, or at 46.5' ABL in the illustrated tanker of 83 feet.

It will be understood by one of skill in the art of naval architecture, in light of the disclosure herein, that more than one bulkhead can be implemented along the height of each wing tank. For such arrangements, it is desirable to evenly space the bulkheads to form stacked wing tanks of approximately equal height. As will be understood from the disclosure hereinbelow, greater numbers of bulkheads would reduce the load upon each bulkhead, and upon the bottom plates, during ballast trips, but would increase the cost of the tanker significantly, due to the additional plumbing, valves, steel and pumps which would be required for each stacked wing tank.

The stacked wing tanks 102, 104 can be filled with ballast for stabilizing the tanker 80 on return trips. Desirably, the tanks are filled with sea water pumped from the ocean through an internal network of pipes (not shown), in a manner well known in the art. A fill line is provided for each of the upper wing tank 102 and the lower wing tank 104 on each of the starboard and port sides.

Desirably, each of the upper wing tank 102 and lower wing tank 104 also includes an overpressure protector. For example, the network of pipes can be fitted with a metering device to determine when an appropriate amount of sea water has passed into one of the tanks 102, 104. The amount should be sufficient to provide ballast but insufficient to over-pressurize the tank. Such metering devices, however, are rarely provided in conventional arrangements for delivery of sea water ballast, since sea water is abundant and costless.

Preferably, the overpressure protector comprises an overflow outlet for each of the stacked wing tanks 102, 104. When one of the tanks is full, overflow water may be directed overboard, for example, through an overflow outlet in the outer side wall 88 (or the outer bottom 90 for the lower wing tank 104). Alternatively, overflow may be directed into a void within the tanker 80 through an overflow outlet in the inner side wall 92 (or the inner bottom 94 for the lower wing tank 104).

With reference to the enlarged schematic view of FIG. 9, the illustrated embodiment includes an upper overflow outlet 106, providing fluid communication between the upper wing tank 102 and the deck 87. Desirably, a short pipe 107 of the outlet 106 communicates directly through the deck 87 from a top level of the upper wing tank 102. It will be understood, however, that in other arrangements, the overflow outlet leading to the deck may comprise piping leading through the inner side wall near the top of the upper wing tank.

A lower overflow outlet 108 also leads to the deck 87. The lower overflow outlet 108 includes a large overflow pipe 110, providing fluid communication from a top level of the lower wing tank 104. Desirably, the pipe 110 is large enough to accommodate the large volumetric flow rate typical of ballast delivery systems. In the illustrated embodiment, the pipe 110 has a 12 inch diameter. The pipe 110 is illustrated as extending directly from a top level of the lower wing tank 104 through the watertight bulkhead 100, through the upper wing tank 102, and through the deck 87. For the illustrated tanker 80, the pipe 110 extends upward about 46.5 feet from the bulkhead 100. It will be understood, however, that in other arrangements, the overflow outlet leading to the deck may comprise piping leading through the inner side wall near the top of the lower wing tank, and upward through the cargo tank.

For embodiments in which the lower overflow outlet 108 extends upward to the deck 87, as illustrated, the lower overflow outlet 108 preferably includes means to zero the pressure at the top of the lower wing tank. The illustrated lower overflow outlet 108 includes a small bleed line 112 in fluid communication with the overflow pipe 110 at the pipe 110 base. The bleed line 112 extends outwardly through the outer side wall 88, and includes a one-way check valve 114, allowing outward flow from the overflow pipe 110 overboard. Preferably, the bleed line 112 also includes a block valve 116, which can be closed to allow maintenance of the system during normal operation.

The bleed line 112 should be small enough to have negligible effect on the function of the lower overflow outlet 108. That is, the bleed line 112 is small enough to divert relatively minimal amounts of overflow from the pipe 110 during filling, such that the detection of overflow at the deck 87 is not delayed. The illustrated bleed line 112 has a diameter of about 2 inches.

In operation, when it is desired to achieve ballast condition, a pump (not shown) can be operated to deliver sea water from the ocean (or other surrounding body of water) to each of the stacked wing tanks 102, 104 through the internal network of pipes. When overflow is witnessed on the deck at one of the overflow outlets 106, 108, the fill line to the corresponding tank 102 or 104 is shut off. The small length of pipe 107 leading to the opening of the upper outlet 106 at the deck 87 remains filled with water. This amount of water is soon purged by motion of the vessel during normal operation.

The overflow pipe 110 of the lower overflow outlet 108 contributes significantly to the pressure within the lower wing tank 104. The small bleed line 112, however, slowly drains water remaining in the overflow pipe 110 after the lower wing tank 104 has been filled. The check valve 114 allows water flow outwardly through the bleed line 112 leading overboard, under pressure from the water column within the pipe 110. Accordingly, within a few hours after filling, the water pressure at the top of the lower wing tank 104, just below the bulkhead 100, is reduced to essentially zero.

Though not illustrated, it will be understood that, when carrying cargo in the tank 85 with an empty inter-hull space 86, the illustrated stacked wing tanker 80 will resemble the conventional double hull tanker 40 illustrated in FIG. 4. The stacked wing tanker 80 will also experience similar pressures as those illustrated in FIG. 5.

Figure 10:
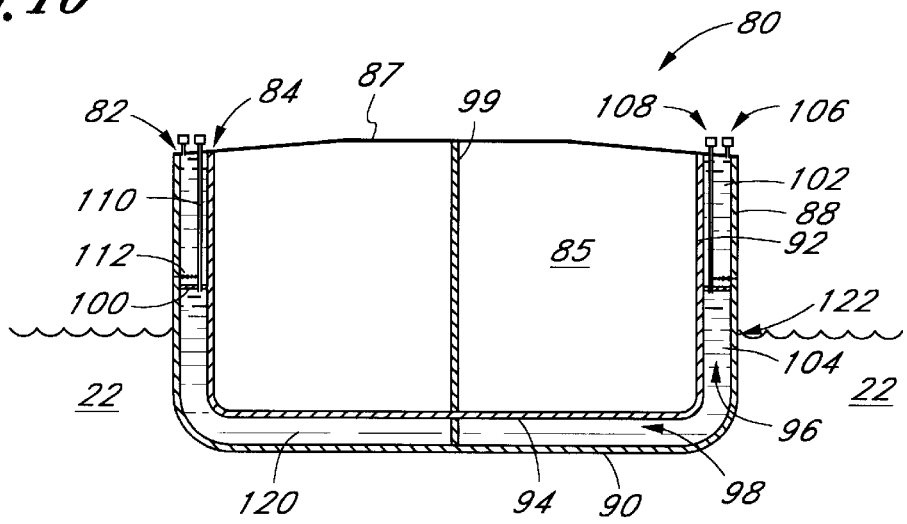
FIG. 10 is a schematic cross-section of the tanker of FIG. 8, shown in a ballast mode.

FIG. 10 illustrates the stacked wing tanker 80 in accordance with the preferred embodiment, shown in a ballast mode. The inter-hull space 86 is divided, on each of the port and starboard sides, into the upper wing tank 102 and the lower wing tank 104 by the bulkhead 100, located at 46.5' ABL. Each of the stacked wing tanks 102, 104 is filled with ballast water 120. The ballasted tanker 80 floats at a ballast draft level 122, located 34' ABL.

Figure 11:
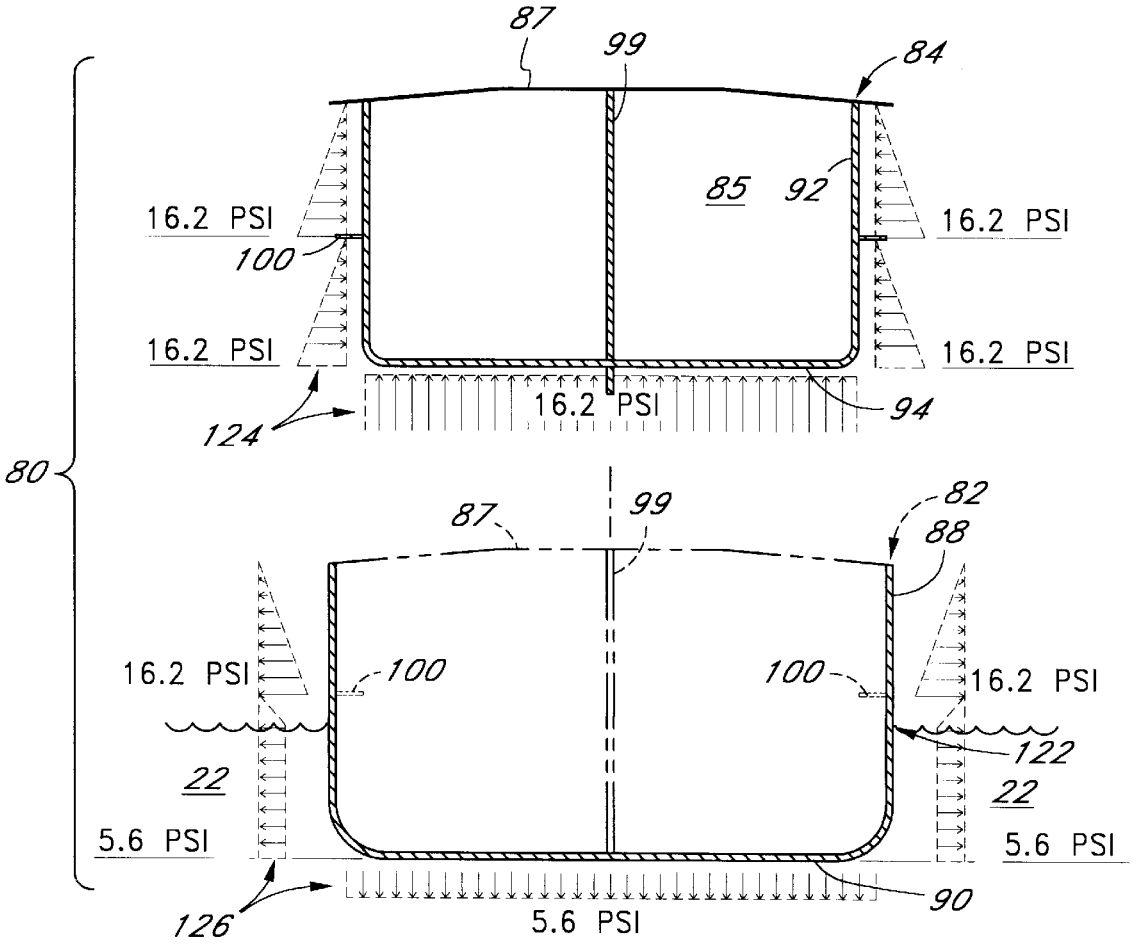
FIG. 11 is an exploded, schematic cross-sectional view of the ballasted tanker of FIG. 10, including a graphical representation of the pressure distribution upon inner and outer shells.

FIG. 11 is an exploded view of the ballasted stacked wing tanker 80 of FIG. 10, with the inner hull 84 and outer hull 82 shown separately to facilitate illustration of the ballast mode pressure distribution along each. The ballast water 120 is not shown. The bulkhead 100 and deck 87 are shown attached to the inner hull 84, but are also shown in dotted lines attached to the outer hull 82, to provide reference points in discussing the pressure distribution.

The ballast sea water 120 within the upper wing tank 102 exerts an inward pressure 124 upon the inner hull 84. The hydrostatic pressure 124 builds linearly within the upper wing tank 102 from zero at the deck 87 to 16.2 psi at the bulkhead 100.

The watertight bulkhead 100 and the overpressure protector ensure that the pressure just below the bulkhead 100 (in the lower wing tank 104) is zero. Accordingly, the pressure 124 drops to zero at the bulkhead 100 and again builds to 16.2 psi at the inner bottom 94. Because the tank 85 is empty, no outward pressure counteracts this inward pressure upon the inner hull 84.

FIG. 11 additionally shows a graphical profile of pressure 126 upon the outer hull 82 in the ballast mode. The inter-hull ballast 120 (FIG. 10) exerts the same pressure on the outer hull 82 as it does upon the inner hull 84. The outward pressure upon the outer hull side wall 88 thus increases linearly from zero at the deck to 16.2 psi at the bulkhead 100 (46.5' ABL).

As noted above, the watertight bulkhead 100 and the overpressure protector ensure that the pressure just below the bulkhead 100 (in the lower wing tank 104) is zero. Accordingly, the pressure 126 drops to zero at the bulkhead 100 and builds linearly downward to 5.6 psi at the draft level 122 (34' ABL). Below the draft level 122, the incremental increases in internal (outward) pressure from the ballast 120 is exactly balanced by the incremental increases in external pressure from the surrounding body of water 22. Accordingly, the net pressure 126 exerted upon the outer hull 82 remains at 5.6 psi from the ballast draft level 122 down to the bottom 90.

Table II summarizes the pressure distributions of the exemplary single hull and double hull tankers, and the preferred stacked wing tanker 80. The maximum pressures for each wall and bottom of the inner and outer hulls (where applicable) are given in pounds per square inch.

TABLE II

| | | SINGLE HULL | DOUBLE HULL | STACKED WING |
|---|---|---|---|---|
| CARGO | outer side wall | 10.7 | 24.4 | 24.4 |
| | outer bottom | 7.3 | 24.4 | 24.4 |
| | inner side wall | — | 27.9 | 27.9 |
| | inner bottom | — | 27.9 | 27.9 |
| BALLAST | outer side wall | 15.1 | 21.8 | 16.2 |

TABLE II-continued

| | SINGLE HULL | DOUBLE HULL | STACKED WING |
|---|---|---|---|
| outer bottom | 15.1 | 21.8 | 5.6 |
| inner side wall | — | 32.4 | 16.2 |
| inner bottom | — | 32.4 | 16.2 |

As is clear from Table II, the conventional double hull configuration results in higher overall pressures, and therefore higher overall stresses, than the single hull tanker. The preferred stacked wing configuration, on the other hand, entails significantly lower pressures in the ballast mode than conventional double hull tanker. In particular, pressures experienced in the double bottom area are reduced by one-half for the inner bottom, and by almost three quarters for the outer bottom. The sidewalls also experience reduced pressures.

Figure 12:
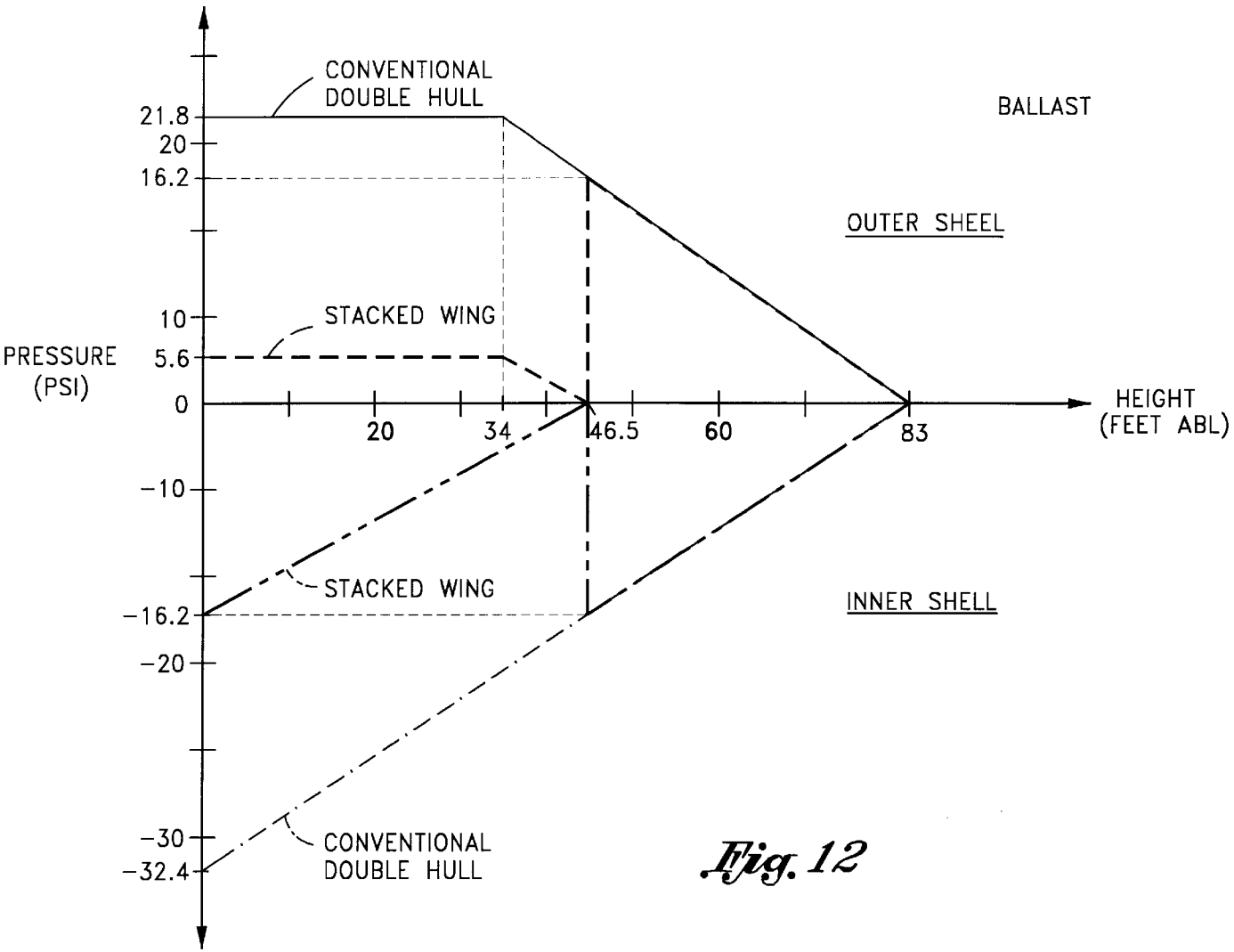
FIG. 12 is a graph of pressure versus height, comparing the pressure distributions of the conventional double hull tanker of FIG. 6 with that of the stacked wing tanker of FIG. 10, each in the ballast mode.

FIG. 12 graphically compares the distribution of pressure upon inner and outer hulls of the conventional double hull tanker 40 and the stacked wing tanker 80, each in the ballast condition. In this graph, as in FIG. 3, negative pressures indicate inward pressure (upon the inner shell), while positive pressures indicate outward pressure (upon the outer shell). FIG. 12 indicates that the pressures experienced by both inner and outer shells are dramatically reduced for the stacked wing tanker 80 below 46.5' ABL.

Because ballast trips typically represent half of the service time of a tanker, the preferred stacked wing tanker can be expected to experience reduced stress and longer service life than conventional double hull tankers. It will be understood that application of the invention described herein may result in even lower overall pressures than those described herein, where a plurality of horizontal, watertight bulkheads are employed to form more than two vertically stacked wing tanks.

Although the foregoing invention has been described in terms of a certain preferred embodiment, other embodiments will become apparent to those of ordinary skill in the art, in view of the disclosure herein. Accordingly, the present invention is not intended to be limited by the recitation of the preferred embodiment, but is instead intended to be defined solely by reference to the appended claims.

I claim:

1. A double hull vessel for the transport of cargo, comprising:

a watertight, pressure-resistant inner hull defining a central cargo tank, the inner hull having inner side walls connected by an inner bottom;

a watertight, pressure-resistant outer hull having outer side walls spaced from the inner side walls, the outer side walls connected by an outer bottom spaced from the inner bottom;

at least one watertight, pressure-resistant bulkhead extending between the inner side wall and the outer side wall, whereby the inner and outer hulls define at least one upper ballast tank and at least one lower ballast tank therebetween, the bulkhead preventing fluid communication between the upper ballast tank and the lower ballast tank;

an upper overflow outlet in fluid communication with the upper ballast tank;

a lower overflow outlet in communication with the lower ballast tank; and a deck extending across and covering the central cargo tank.

2. The double hull vessel in accordance with claim 1, wherein the lower overflow outlet is in communication with the lower ballast tank near a top level of the lower ballast tank.

3. The double hull vessel in accordance with claim 2, wherein the lower overflow outlet comprises an overflow pipe in fluid communication with and extending from the lower ballast tank to the deck.

4. The double hull vessel in accordance with claim 3, wherein the lower overflow outlet further comprises a bleed line extending from the overflow pipe through the outer side wall, the bleed line including a one-way check valve allowing flow from the overflow pipe and through the outer side wall.

5. The double hull vessel in accordance with claim 1, further comprising a longitudinal, vertical partition dividing the cargo tank and the lower ballast tank into starboard and port sides.

6. The double hull vessel in accordance with claim 1, wherein the bulkhead is positioned at a height between about 35% and 65% of a distance between the inner bottom and the deck.

7. The double hull vessel in accordance with claim 1, wherein the bulkhead is positioned at a height about half way between the inner bottom and the deck.

8. A stacked wing tanker for fluid transportation, comprising:

a watertight central storage tank, the tank including a pair of lateral inner side walls, an inner bottom extending between lower ends of the side walls, and a deck extending between upper ends of the side walls;

a watertight, pressure-resistant outer hull extending around and spaced from the lateral inner side walls and inner bottom of the storage tank, a double bottom ballast space defined between the outer hull and the inner bottom, and a pair of wing tanks defined between the outer hull and the lateral side walls;

an overpressure protector for each of the upper wing tanks and the lower wing tanks; and at least one watertight, pressure-resistant bulkhead dividing each of the wing tanks into an upper wing tank stacked upon a lower wing tank.

9. The stacked wing tanker in accordance with claim 8, wherein the lower wing tank is in fluid communication with the bottom ballast space.

10. The stacked wing tanker in accordance with claim 8, wherein each overpressure protector comprises an overflow outlet at a top level of the corresponding wing tank.

11. A method of reducing pressure at bottom regions of a double hull vessel of a type including an inner hull defining a cargo tank and an outer hull spaced therefrom, the method comprising:

providing a horizontal, watertight bulkhead between the inner and outer hulls, thereby defining at least one upper ballast wing tank and at least one lower ballast wing tank;

filling the lower ballast wing tank with ballast;

stopping the filling step when overflow ballast flows through an overflow pipe in fluid communication with the lower ballast wing tank and an overflow outlet positioned above the watertight bulkhead;

allowing an amount of ballast left in the overflow pipe after stopping the filling to bleed out of the overflow pipe.

12. A double hull vessel for the transport of cargo, comprising:

a watertight, pressure-resistant inner hull defining a central cargo tank, the inner hull having inner side walls connected by an inner bottom;

a watertight, pressure-resistant outer hull having outer side walls spaced from the inner side walls, the outer side walls connected by an outer bottom spaced from the inner bottom;

at least one watertight, pressure-resistant bulkhead extending between the inner side wall and the outer side wall, whereby the inner and outer hulls define at least one upper ballast tank and at least one lower ballast tank therebetween, the bulkhead preventing fluid communication between the upper ballast tank and the lower ballast tank;

a deck extending across and covering the central cargo tank, and an upper overflow outlet in fluid communication with the upper ballast tank and a lower overflow outlet in communication with the lower ballast tank near a top level of the lower ballast tank, wherein the lower overflow outlet includes:

an overflow pipe in fluid communication with and extending from the lower ballast tank to the deck, and a bleed line extending from the overflow pipe through the outer side wall, the bleed line including a one-way check valve allowing flow from the overflow pipe and through the outer side wall.

* * * * *